US010127852B2

(12) United States Patent
Li et al.

(10) Patent No.: US 10,127,852 B2
(45) Date of Patent: Nov. 13, 2018

(54) METHOD FOR ADJUSTING DISPLAY PARAMETERS AND DISPLAY DEVICE USING THE SAME

(71) Applicant: AMBIT MICROSYSTEMS (SHANGHAI) LTD., Shanghai (CN)

(72) Inventors: Wu-Kui Li, GuangDong (CN); Xin-Lin Xiao, GuangDong (CN); Yu-Chan Nieh, New Taipei (TW)

(73) Assignee: AMBIT MICROSYSTEMS (SHANGHAI) LTD., Shanghai (CN)

( * ) Notice: Subject to any disclaimer, the term of this patent is extended or adjusted under 35 U.S.C. 154(b) by 0 days.

(21) Appl. No.: 15/347,808

(22) Filed: Nov. 10, 2016

(65) Prior Publication Data

US 2018/0090045 A1 Mar. 29, 2018

(30) Foreign Application Priority Data

Sep. 26, 2016 (CN) ..... 2016 1 0851703

(51) Int. Cl.
*G09G 3/36* (2006.01)
*G09G 3/20* (2006.01)

(52) U.S. Cl.
CPC ... *G09G 3/2003* (2013.01); *G09G 2320/0626* (2013.01)

(58) Field of Classification Search
CPC ..... G09G 3/3406; G09G 2320/0626
USPC ..... 345/87–89, 102
See application file for complete search history.

(56) References Cited

U.S. PATENT DOCUMENTS 8,462,101 B2 * 6/2013 Han ..... G09G 3/3406 345/102
2005/0212824 A1 * 9/2005 Marcinkiewicz .... G09G 3/3406 345/690
2013/0147981 A1 6/2013 Wu

FOREIGN PATENT DOCUMENTS

CN 103165103 A 6/2013
CN 102810306 B 1/2015

* cited by examiner

*Primary Examiner* — Roy P Rabindranath
(74) *Attorney, Agent, or Firm* — ScienBiziP, P.C.

(57) ABSTRACT

A method for adjusting display parameters in a display device detects a change (second intensity value) in ambient light levels from a first intensity value of ambient light and corresponding first set of display parameters applied to the display device. Second set of display parameters are calculated according to the first intensity value and the second intensity value as well as the first set of display parameters. The display parameters of the display device are adjusted from the first set of display parameters to the second set of display parameters to take account of the change represented by the second intensity value.

8 Claims, 5 Drawing Sheets

METHOD FOR ADJUSTING DISPLAY PARAMETERS AND DISPLAY DEVICE USING THE SAME

FIELD

The subject matter herein generally relates to display technologies.

BACKGROUND

Display parameters, for example, brightness, hue, and saturation, for a television (TV) are generally preset by manufactures or users. The TV is unable to automatically adjust the display parameters according to environmental variations, such as the ambient brightness, hue, or background lights. Since environmental variations require individualized requirements for each user, users often settle with incorrect display parameters which results in bad user experiences.

BRIEF DESCRIPTION OF THE DRAWINGS

Implementations of the present technology will now be described, by way of example only, with reference to the attached figures.

DETAILED DESCRIPTION

Figure 1:
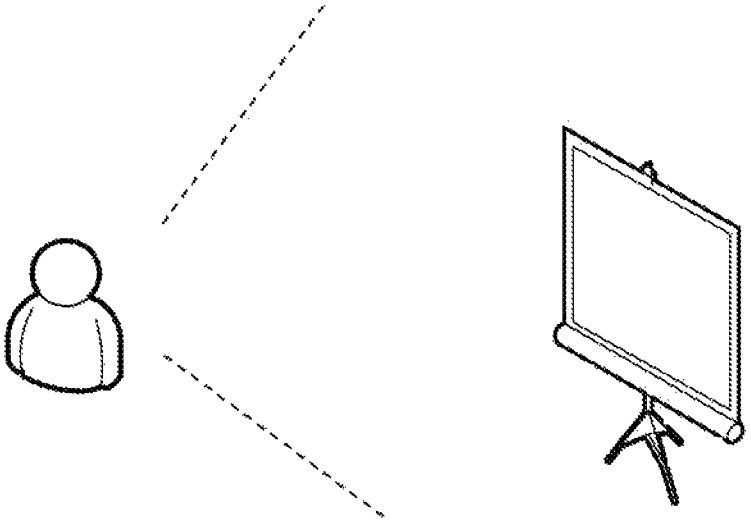
FIG. 1 is a diagrammatic view of an exemplary embodiment of an environment for parameters adjustment of a display device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts have been exaggerated to better illustrate details and features of the present disclosure.

It should be noted that references to "an" or "one" exemplary embodiment in this disclosure are not necessarily to the same exemplary embodiment, and such references mean "at least one."

In general, the word "module" as used hereinafter, refers to logic embodied in computing or firmware, or to a collection of software instructions, written in a programming language, such as, Java, C, or assembly. One or more software instructions in the modules may be embedded in firmware, such as in an erasable programmable read only memory (EPROM). The modules described herein may be implemented as either software and/or computing modules and may be stored in any type of non-transitory computer-readable medium or other storage device. Some non-limiting examples of non-transitory computer-readable media include CDs, DVDs, BLU-RAY, flash memory, and hard disk drives. The term "comprising", when used, means "including, but not necessarily limited to"; it specifically indicates open-ended inclusion or membership in a so-described combination, group, series, and the like.

FIG. 1 illustrates an exemplary embodiment of parameters adjustment of a display device. In this exemplary embodiment, the TV displays a program and monitors the change of ambient light intensity. In the exemplary embodiment, the TV automatically adjusts display parameters if the change of the ambient light intensity exceeds a preset value. The display parameters include a brightness value and a saturation value.

Figure 2A:
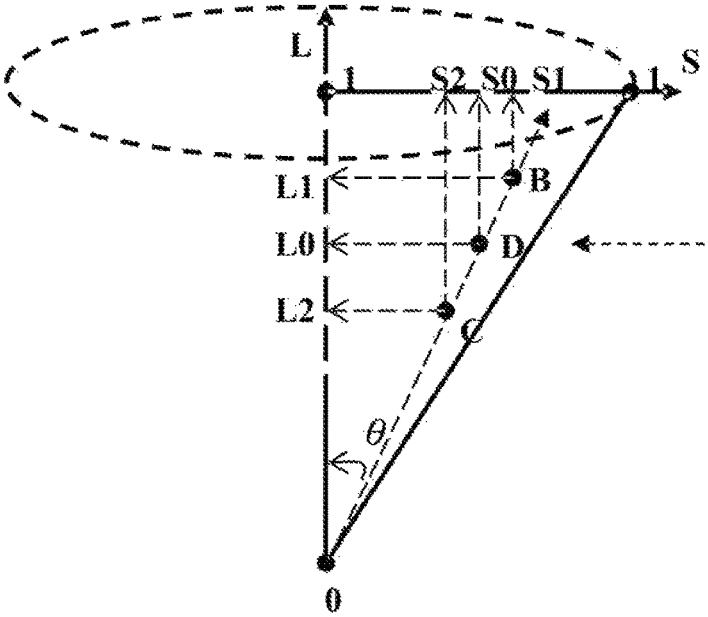
FIGS. 2A and 2B are diagrammatic views of an exemplary embodiment of a relationship between brightness and saturation and corresponding intensity of ambient light used in the parameters adjustment process of FIG. 1.
Figure 2B:
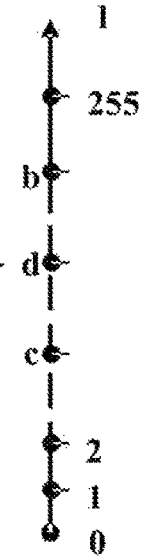

FIGS. 2A and 2B illustrate an exemplary embodiment of a relationship between brightness and saturation and the corresponding intensity of the ambient light.

FIG. 2A illustrates a conical space model. The vertical axis of the conical space model represents the brightness (D), the circle represents a hue, and the radius represents the degree of the saturation (S). Referring to FIG. 2A, the hue value is fixed, the brightness and saturation values are variable within a preset relationship. When the brightness value increases, the saturation value needs to be increased to guarantee the color output is within a range of sensitivity.

The marked points in FIG. 2B, from zero to 255, are the detected intensity values of the ambient light. The marked points are mapped to points from the cone in FIG. 2A. The range of intensity values of the ambient light is from 0 to 255 ($2^0-1$ to $2^8-1$), from the lowest 0 to the highest 255.

As an example, taking a point D as an initial point of the cone in FIG. 2A. The brightness value of the point D is $L_0$ and the saturation value of the point D is $S_0$, so coordinates of the point D are ($L_0$, $S_0$). According to the $L_0$ and the $S_0$, $$\tan\theta = \frac{S_0}{L_0}$$

is equals a constant, and the point D corresponds to a point d in FIG. 2B. In one exemplary embodiment, after the constant tan θ is determined, a ratio of the saturation value to the brightness value is a constant tan θ. Regardless of a change of the intensity value of the ambient light on the cone. Referring to FIG. 2A, if the point which represents ambient light intensity moves from d to b, the applicable display parameters of the display device will be correspondingly moved from D to B, according to the mapping relationship. The brightness value of the point B is $L_1$, and the saturation value is $S_1$, so coordinates of the B are ($L_1$,$S_1$). According to the mathematical model of the cone, the relationship between the ambient light intensity and the conical space model can be calculated as $$L_1 - L_0 = \frac{|b-d|}{256},$$

deriving $$L_1 = \frac{|b-d|}{256} + L_0.$$

According to the ratio $$\tan\theta = \frac{S_0}{L_0}$$

of the saturation value to the brightness value, $S_1=L_1*\tan\theta$ is calculated, that is $$S_1 = \left(\frac{|b-d|}{256} + L_0\right) * \tan\theta.$$

In the exemplary embodiment, when the ambient light intensity changes from point d to point b, the brightness value and the saturation value change from an initial point ($L_0$, $S_0$) to the point ($L_1$, $S_1$). Correspondingly, an adjustment system adjusts display parameters from ($L_0$, $S_0$) to ($L_1$, $S_1$). Thus, adjustment coordinates for display of a video based on ambient light intensity and the light intensity are mapped out.

Figure 3:
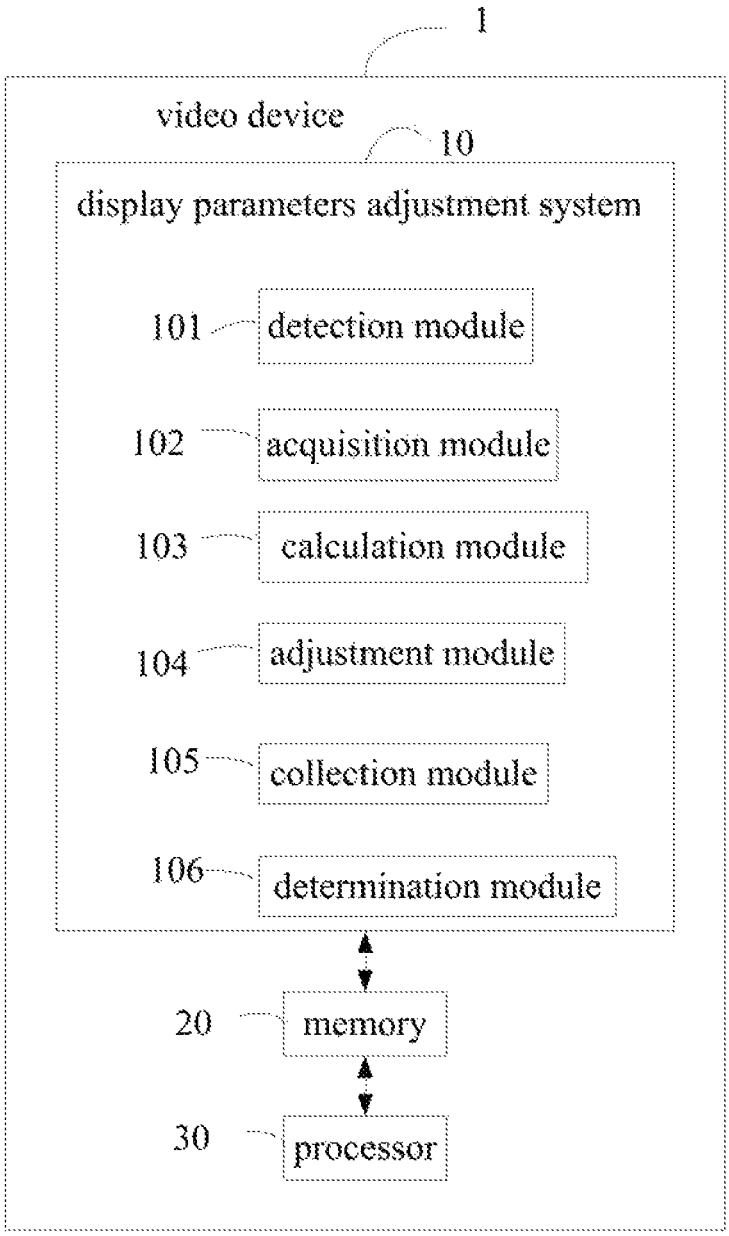
FIG. 3 is a block diagram of an exemplary embodiment of functional modules of the adjustable display device of FIG. 1.

FIG. 3 illustrates an exemplary embodiment of functional modules of a display device of FIG. 1. The video device 1 comprises a brightness and saturation adjustment device including display parameters adjustment system 10, a memory 20, and a processor 30. The display parameters adjustment system 10 includes a detection module 101, an acquisition module 102, a calculation module 103, an adjustment module 104, a collection module 105, and a determination module 106.

The detection module 101 detects a second intensity value of the ambient light.

The acquisition module 102 acquires a first intensity value of ambient light retained from an initial or prior reading, and a first set of display parameters are applied to the display device corresponding to the first intensity value of the ambient light.

The calculation module 103 calculates a second set of display parameters of the current environment according to the first intensity value of the ambient light, the second intensity value of the ambient light, and the first set of display parameters of the display device.

The adjustment module 104 adjusts the display parameters of the display device from the initial set of display parameters to the second set of display parameters according to the second set of display parameters.

Over a cycle time for collecting ambient light, wherein the cycle time at most includes a time of collecting n intensity values of ambient light, the collection module 105 collects at most n intensity values of ambient light from the current environment. The cycle time is divided into effective cycle time and ineffective cycle.

In one exemplary embodiment, in at most n intensity values of the ambient light, the method of determining whether the cycle time is the effective cycle time is to compare a currently detected intensity value of the ambient light from the n intensity values of the ambient light with a prior intensity value of the ambient light. When difference between each of the n intensity values of the ambient light and the prior intensity value of the ambient light is not greater than a preset value, wherein the preset value is set according to change of the ambient light of the environment, the cycle time is determined to be effective, otherwise the cycle time is ineffective.

The determination module 106 determines whether the cycle time is an effective cycle time according to the n intensity values of the ambient light.

The modules 101-106 are executed by one or more processors 30. Each module of the present disclosure is a computer program or segment of a program for completing a specific function. A memory 20 stores the program code and other information of the display parameters adjustment system 10.

Figure 4:
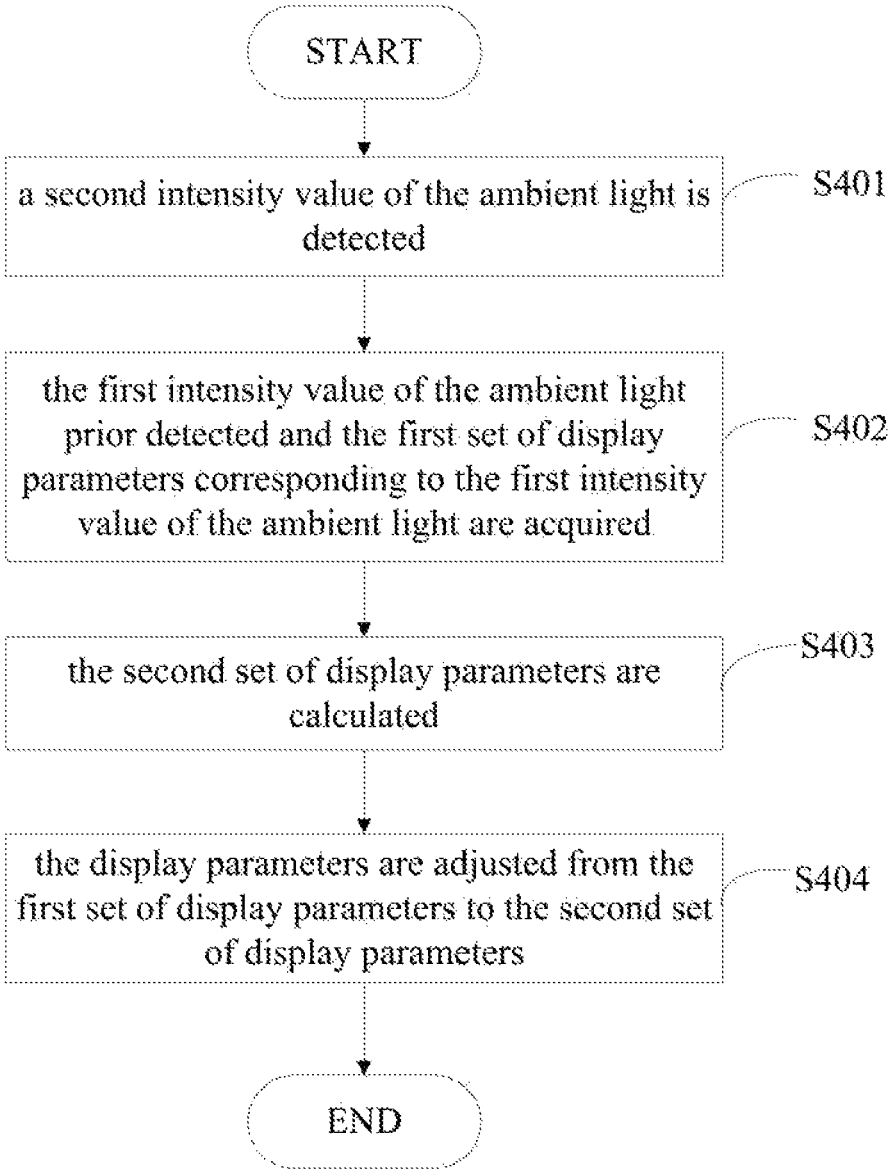
FIG. 4 is a flowchart of an exemplary embodiment of a method for adjusting display parameters.

FIG. 4 illustrates an exemplary embodiment of a method for adjusting display parameters. The method can be applied to a display device, such as a television, a projector, a computer display device, or any device with display function. The display parameters include a brightness value and a saturation value. A ratio tan θ of the saturation value to the brightness value is a predetermined constant. A range of intensity values of the ambient light of the environment is 0 to N−1. When the ambient light intensity changes, the display device adjusts the display parameters according to a result of comparison between the detected current second intensity value of the ambient light and the presently-pertaining first intensity value of brightness.

At block 401, a second intensity value of the ambient light is detected. In one exemplary embodiment, the second intensity value of the ambient light is an average value of n intensity values of the ambient light in an effective cycle time.

In one exemplary embodiment, at most n intensity values of the ambient light in a cycle time are periodically collected from the current environment. In at most n intensity values of the ambient light, the method of determining whether the cycle time is the effective cycle time is to compare a currently detected intensity value of the ambient light from the n intensity values of the ambient light with a prior intensity value of the ambient light. When difference between each of the n intensity values of the ambient light and the prior intensity value of the ambient light is not greater than a preset value, wherein the preset value is set according to change of the ambient light of the environment, the cycle time is determined to be effective, otherwise the cycle time is ineffective. If the cycle time is an effective cycle time, the number of times of collected intensity values is equal to n, otherwise the number is less than n.

In one exemplary embodiment, at most n intensity values of the ambient light in a cycle time are periodically collected from the current environment. According to the number of times of the collected intensity values, the cycle time is determined whether it is an effective cycle time according to the at most n intensity values of the ambient light. When the cycle time is an ineffective cycle time, the collection operation within this cycle time is terminated, and the collection operation in a next cycle time is re-started until an effective cycle time is determined. The average value of n intensity values of the ambient light within the effective cycle time, serves as the second intensity value of the ambient light.

In one exemplary embodiment, after intensity values of the ambient light of an n length cycle time collection starts, whether the difference between the currently collected intensity value of the ambient light and the last intensity value of the ambient light is greater than a first preset value 20 is determined. If the difference is greater than 20, the collected intensity value of the ambient light is determined ineffective, that is to say, the ambient light is unstable, and the collecting operation in current cycle time terminates, and a collecting operation in a next cycle time re-starts. If the difference is less than 20, the currently collected intensity value of the ambient light is determined effective. That is to say, the ambient light changes within a range of variation, the current collection of intensity value of the ambient light is recorded, and begins to make a preparation for a next collection of intensity value of the ambient light. When each of the n effective intensity values of the ambient light are recorded, the collecting operation in this cycle time is finished, and the average value of the n effective intensity values of the ambient light is calculated. The average value is the second intensity value of the ambient light.

Difference between the second intensity value of the ambient light and a first intensity value of the ambient light is calculated, wherein the first intensity value of the ambient light is an average value of the detected n intensity values of the ambient light in a last effective cycle time. If the difference is greater than a second preset value 10, that is, the ambient light intensity changes out of a preset range, the display parameters of the display device are adjusted from the first set of display parameters to the second set of display parameters. The first set of display parameters correspond to the first intensity value of the ambient light, and the second set of display parameters correspond to the second intensity value of the ambient light. If the difference is less than the second preset value 10, that is to say, the ambient light intensity changes a little, the display parameters of the display device remain unchanged.

At block 402, the first intensity value of the ambient light prior detected and the first set of display parameters corresponding to the first intensity value of the ambient light are acquired. The first intensity value of the ambient light is the average value of the detected n intensity values of the ambient light in the last effective cycle time.

At block 403, the second set of display parameters are calculated according to the first intensity value of the ambient light, the second intensity value of the ambient light, and the first set of display parameters of the display device. The display parameters include the brightness and the saturation, and the first or second set of display parameters include both the brightness value and the saturation value.

In one exemplary embodiment, the method of calculating the second set of display parameters is:

$$L_2 = \frac{|b-d|}{N} + L_1,\ S_2 = \left(\frac{|b-d|}{N} + L_1\right) * \tan\theta,$$

wherein, a ratio of the brightness value to the saturation value is a preset content tan θ. The N is a preset intensity value of the ambient light, and a range of the ambient light intensity is 0 to N−1. The $L_1$ stands for a brightness value of the first set of display parameters. The $L_2$ stands for a brightness value of the second set of display parameters. The b stands for the detected second intensity value of the ambient light. The d stands for the first intensity value of the ambient light. The $S_2$ stands for a saturation value of the second set of display parameters.

At block 404, the display parameters are adjusted from the first set of display parameters to the second set of display parameters according to the calculated second set of display parameters. In one exemplary embodiment, the second set of display parameters are recorded, and the ambient light intensity continues to be detected after the display parameters of the display device are adjusted.

Figure 5:
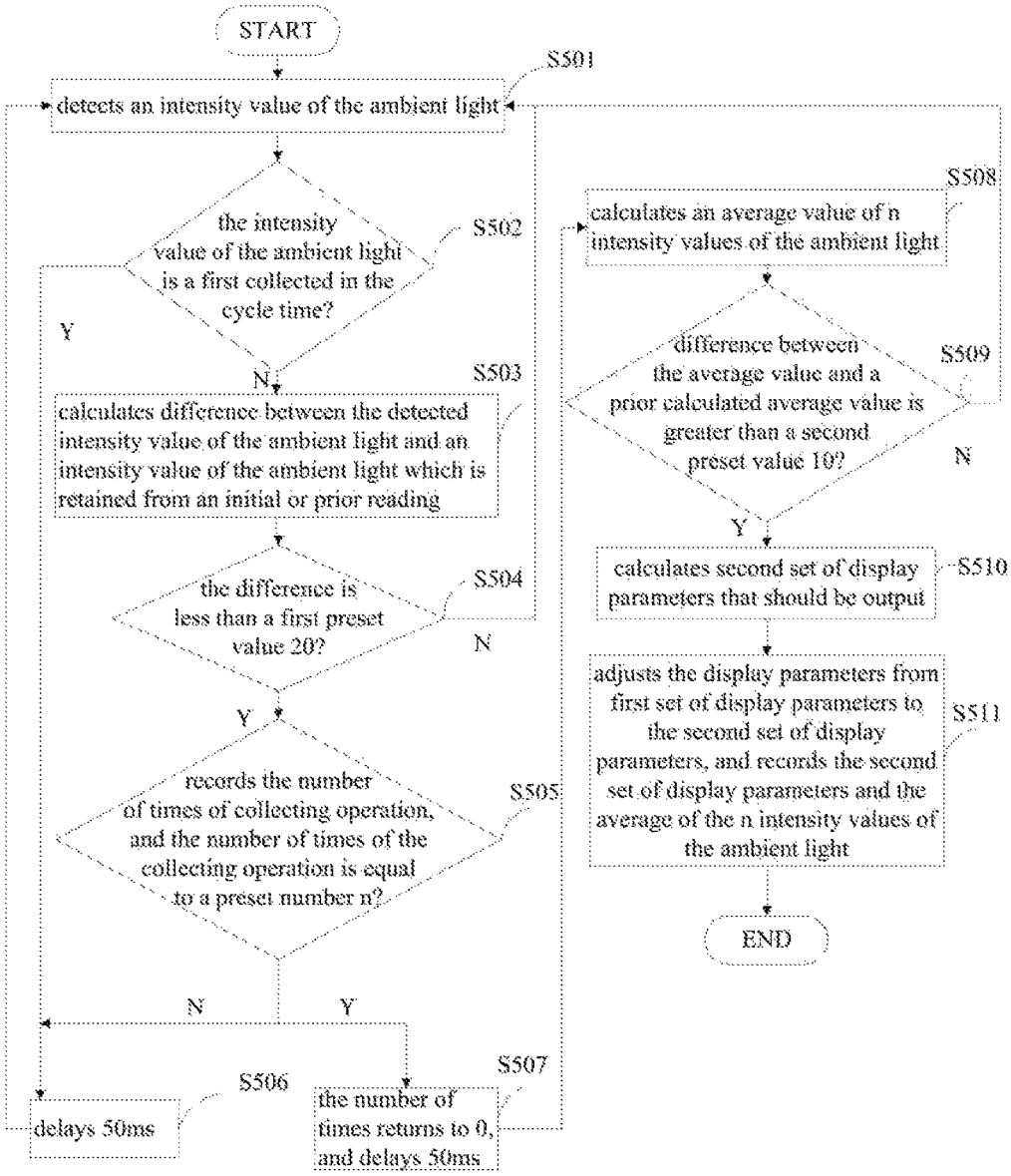
FIG. 5 is a specific flowchart of an exemplary embodiment of the method for adjusting display parameters.

FIG. 5 illustrates a specific flowchart of one exemplary embodiment of the method for adjusting display parameters.

At block 501, the display device detects an intensity value of the ambient light.

At block 502, the display device determines whether the intensity value of the ambient light is first collected in the cycle time. If not, a block 503 is executed, otherwise a block 506 is executed.

At block 503, the display device calculates difference between the detected intensity value of the ambient light and an intensity value of the ambient light which is retained from an initial or prior reading.

At block 504, the display device determines whether the difference is less than a first preset value 20. If the difference is less than 20, a block 505 is executed, otherwise the block 501 returns to be executed.

At block 505, the display device records the number of times of collecting operation, and determines whether the number of times of the collecting operation is equal to a preset number n. If the number of times of collecting operation is not equal to n, a block 506 is executed, otherwise a block 507 is executed.

At block 506, the display device delays 50 ms, then the block 501 returns to be executed.

At block 507, the number of times returns to 0, and delays 50 ms, then a block 508 continues to be executed.

At block 508, the display device calculates an average value of n intensity values of the ambient light.

At block 509, the display device determines whether difference between the average value and a prior calculated average value is greater than a second preset value 10. If the difference is greater than 10, a block 510 is executed, otherwise the block 501 returns to be executed.

At block 510, the display device calculates second set of display parameters that should be output.

At block 511, the display device adjusts the display parameters from first set of display parameters to the second set of display parameters, and records the second set of display parameters and the average of the n intensity values of the ambient light.

The method for adjusting display parameters and display device using the same can provide the user with a comfortable visual experience, regardless of the change of the ambient light intensity in watching TV.

It should be emphasized that the above-described exemplary embodiments of the present disclosure, including any particular exemplary embodiments, are merely possible examples of implementations, set forth for a clear understanding of the principles of the disclosure. Many variations and modifications can be made to the above-described exemplary embodiment(s) of the disclosure without departing substantially from the spirit and principles of the disclosure. All such modifications and variations are intended to be included herein within the scope of this disclosure and protected by the following claims.

What is claimed is:

1. A method for adjusting display parameters of a display device, comprising:

detecting a second intensity value of ambient light, wherein the second intensity value of the ambient light is an average value of n intensity values of the ambient light within an effective cycle time, wherein n is an integer with a preset range;

acquiring a first intensity value of ambient light retained from an initial or prior reading, wherein the first intensity value of the ambient light is an average value of the n intensity values of the ambient light within a prior effective cycle time from the effective cycle time for detecting the second intensity value;

applying a first set of display parameters to the display device corresponding to the first intensity value of the ambient light;

calculating a second set of display parameters according to the first intensity value of the ambient light, the second intensity value of the ambient light, and the first set of display parameters of the display device; and adjusting the display parameters of the display device from the first set of display parameters to the second set of display parameters;

wherein the display parameters of the display device include brightness and saturation, the first or second set of display parameters include both a brightness and a saturation values, a ratio of the brightness value to the saturation value is equals a preset constant tan θ, θ is a default angle, and a range of the intensity value of the ambient light is 0 to N−1.

2. The method for adjusting display parameters of claim 1, wherein the second set of display parameters may be calculated as follows:

$$L_2 = \frac{|b-d|}{N} + L_1; \text{ and}$$

$$S_2 = \left(\frac{|b-d|}{N} + L_1\right) * \tan\theta,$$

wherein, the $L_1$ stands for a brightness value of the first set of display parameters, the $L_2$ stands for a brightness value of the second set of display parameters, the b stands for the second intensity value of the ambient light, the d stands for the first intensity value of the ambient light, and the $S_2$ stands for a saturation value of the second set of display parameters.

3. The method for adjusting display parameters of claim 1, wherein the detecting step of the second intensity value further comprises:

periodically collecting at most n intensity values of ambient light within a cycle time;

determining the cycle time is an effective cycle time when number of collected intensity values equals n; and when the cycle time is an ineffective cycle time, terminating the collecting operation within the cycle time, and continuously re-starting the collecting operation for a next cycle time until an effective cycle time is determined, wherein the average value of n intensity values of the ambient light within the effective cycle time serves as the second intensity value of the ambient light.

4. The method for adjusting display parameters of claim 3, wherein the determining the cycle time is an effective cycle time step further comprises:

among the n intensity values of the ambient light, comparing a currently detected intensity value of the ambient light from the n intensity values of the ambient light with a prior intensity value of the ambient light; and after comparisons for the overall n intensity values of the ambient light, difference between one of the n intensity values of the ambient light and its prior intensity value of the ambient light is greater than a preset value, determining the cycle time as an effective cycle time.

5. A display device, comprising:

at least one processor;

a non-transitory storage system coupled to the at least one processor and configured to store one or more programs configured to be executed by the at least one processor, the one or more programs comprising instructions for:

detecting a second intensity value of ambient light, wherein the second intensity value of the ambient light is an average value of n intensity values of the ambient light within an effective cycle time, wherein n is an integer with a preset range;

acquiring a first intensity value of ambient light retained from an initial or prior reading, wherein the first intensity value of the ambient light is an average value of the n intensity values of the ambient light within a prior effective cycle time from the effective cycle time for detecting the second intensity value;

applying a first set of display parameters to the display device corresponding to the first intensity value of the ambient light;

calculating a second set of display parameters according to the first intensity value of the ambient light, the second intensity value of the ambient light, and the first set of display parameters of the display device; and adjusting the display parameters of the display device from the first set of display parameters to the second set of display parameters;

wherein the display parameters of the display device include brightness and saturation, the first or second set of display parameters include both a brightness and a saturation values, a ratio of the brightness value to the saturation value is equals a preset constant tan θ, θ is a default angle, and a range of the intensity value of the ambient light is 0 to N−1.

6. The display device of claim 5, wherein the second set of display parameters may be calculated as follows:

$$L_2 = \frac{|b-d|}{N} + L_1; \text{ and}$$

$$S_2 = \left(\frac{|b-d|}{N} + L_1\right) * \tan\theta,$$

wherein, the $L_1$ stands for a brightness value of the first set of display parameters, the $L_2$ stands for a brightness value of the second set of display parameters, the b stands for the second intensity value of the ambient light, the d stands for the first intensity value of the ambient light, and the $S_2$ stands for the saturation value of the second set of display parameters.

7. The display device of claim 5, wherein the display device further comprises:

periodically collecting at most n intensity values of ambient light within a cycle time;

determining the cycle time is an effective cycle time when number of collected intensity values equals n; and when the cycle time is an ineffective cycle time, terminating the collecting operation within the cycle time, and continuously re-starting the collecting operation for a next cycle time until an effective cycle time is determined, wherein the average value of n intensity values of the ambient light within the effective cycle time serves as the second intensity value of the ambient light.

8. The display device of claim 7, wherein the display device further comprises:

among the n intensity values of the ambient light, comparing a currently detected intensity value of the ambient light from the n intensity values of the ambient light with a prior intensity value of the ambient light; and after comparisons for the overall n intensity values of the ambient light, difference between one of the n intensity values of the ambient light and its prior intensity value of the ambient light is greater than a preset value, determining the cycle time as an effective cycle time.

* * * * *